United States Patent [19]

Thurow

[11] 4,333,200

[45] Jun. 8, 1982

[54] CHIMNEY CLEANER

[76] Inventor: Russel E. Thurow, 115 Tami La., Mankato, Minn. 56001

[21] Appl. No.: 190,726

[22] Filed: Sep. 25, 1980

[51] Int. Cl.[3] ..... F23J 3/00

[52] U.S. Cl. ..... 15/243; 15/104.18

[58] Field of Search ..... 15/104.18, 163, 243

[56] References Cited

U.S. PATENT DOCUMENTS

| | | | |
|---|---|---|---|
| 1,582,309 | 4/1926 | Satterberg | 15/243 |
| 1,603,153 | 10/1926 | Schaefer . | |
| 1,776,277 | 9/1930 | Battocletti . | |
| 1,806,387 | 5/1931 | Carney . | |
| 1,926,753 | 9/1933 | Rickabaugh | 15/163 |
| 2,208,901 | 7/1940 | Hawkinson | 15/163 |
| 2,602,177 | 7/1952 | Aho | 15/163 |
| 3,977,331 | 8/1976 | Clavin | 15/104.18 X |
| 4,085,477 | 4/1978 | Anderson | 15/243 |
| 4,090,271 | 5/1978 | Piontkowski et al. | 15/243 |
| 4,208,756 | 6/1980 | Smith | 15/243 |

*Primary Examiner*—Robert L. Bleutge

*Attorney, Agent, or Firm*—Kinney, Lange, Braddock, Westman and Fairbairn

[57] ABSTRACT

A chimney cleaner device cleans the inside surfaces of a chimney in both an upward and downward direction. The device includes a pair of diverging cleaning arms made of heavy metal, each arm having an integral shank portion and blade portion. The blade portion has an outermost scraping edge and a beveled surface slanting inwardly from the cleaning edge to an end of the blade portion opposite the shank portion. The cleaning arms are pivotally connected at an end of the shank portion opposite the blade portion, and are biased outwardly about the pivotal connection in a diverging manner by a lateral force such that the scraping edges engage the inside surfaces of the chimney. The combination of the weight of the cleaning arms and the beveled surface are sufficient to overcome the lateral force allowing downward scraping of the chimney. Upward cleaning of the chimney is accomplished by simply pulling the device up the chimney.

9 Claims, 4 Drawing Figures

CHIMNEY CLEANER

BACKGROUND OF THE INVENTION

1. Field of the Invention

The present invention relates to chimney cleaners. In particular, it relates to chimney cleaners that are capable of cleaning the inside surfaces of a chimney in both an upward and downward direction.

2. Description of the Prior Art

Chimneys collect soot, creasol and other debris on their inside surfaces and must be cleaned from time-to-time. In the prior art there are several patents which show chimney cleaner devices for cleaning of chimneys. The prior art patents are:

Schaefer U.S. Pat. No. 1,603,153
Battocletti U.S. Pat. No. 1,776,277
Carney U.S. Pat. No. 1,806,387
Rickabaugh U.S. Pat. No. 1,926,753
Hawkinson U.S. Pat. No. 2,208,901
Aho U.S. Pat. No. 2,602,177

In general, each of the above mentioned prior art patents shows a chimney cleaner device having at least two members with brushes at their lower ends. In each case, some form of spring-loaded mechanism which, when released, permits the members to move outwardly with the brushes engaging the inside surfaces of the chimney. With the brushes engaging the inside surfaces of the chimney, the chimney cleaner is pulled upwardly using a rope or chain, either by hand or winch, with the soot and other debris being brushed away from the surfaces of the inside walls. For example, the Schaefer patent shows arms which provide their own outward spring action brushes carried by the arms which engage the inside surfaces of the chimney. The arms are initially at an inoperative position for lowering of the chimney cleaner down the chimney and are released by a tripping mechanism for engaging the inside wall surfaces for cleaning.

Each of the chimney cleaning devices, in the above-mentioned patents, permits cleaning of the chimney in only the upward direction. Each device has to be returned to the inoperative position and relowered for re-releasing the outwardly biased arms. In addition, the complicated holding and release mechanisms of the prior art cleaning devices have shortcomings in their durability and reliability after extended use in the adverse environment of the chimney.

SUMMARY OF THE INVENTION

The present invention provides a chimney cleaner device that cleans the inside surfaces of a chimney in both an upward and downward direction. The chimney cleaner device includes a pair of diverging cleaning arms with each arm having an integral shank portion and blade portion, the blade portion having an outermost scraping edge and a beveled surface slanting inwardly from the cleaning edge to an end of the blade portion opposite the shank portion. The cleaning arms are pivotally connected at an end of the shank portion opposite the blade portion of each arm. The cleaning arms are biased outwardly for engaging the inside surfaces of the chimney with the scraping edges. The combination of the weight of the cleaning arms and the beveled surface permit downward movement in the chimney. The device is simply pulled upward by a rope for cleaning the chimney in an upward direction.

DETAILED DESCRIPTION OF THE PREFERRED EMBODIMENTS

Figure 1:
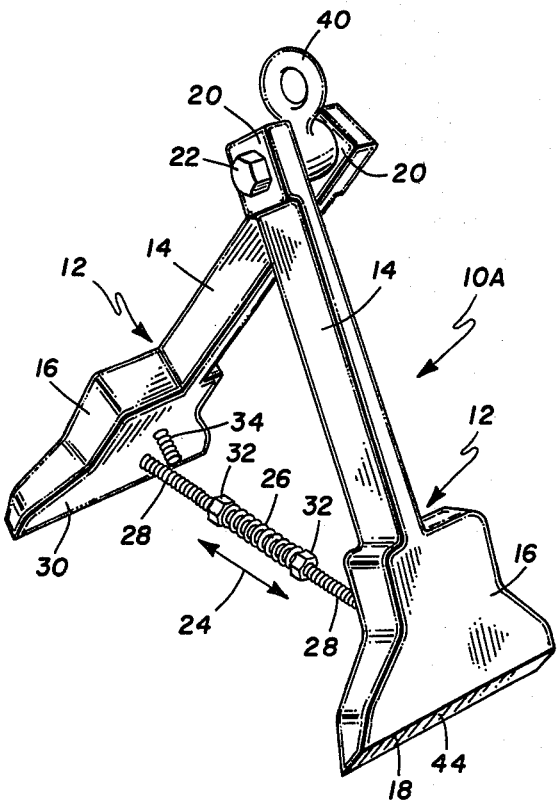
FIG. 1 is a perspective view of one embodiment of the present invention having a rectangular lateral cross-section for cleaning a rectangular shaped chimney.
Figure 3:
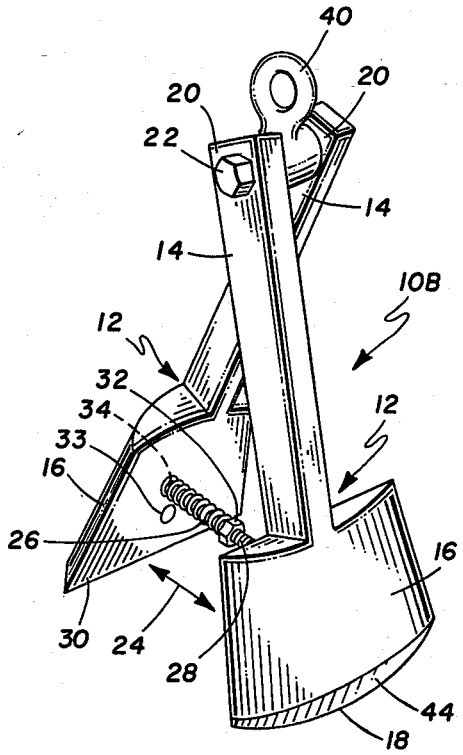
FIG. 3 is a perspective view of another embodiment of the chimney cleaner having a lateral arcuate blade surface for cleaning circular shaped chimneys.
Figure 2:
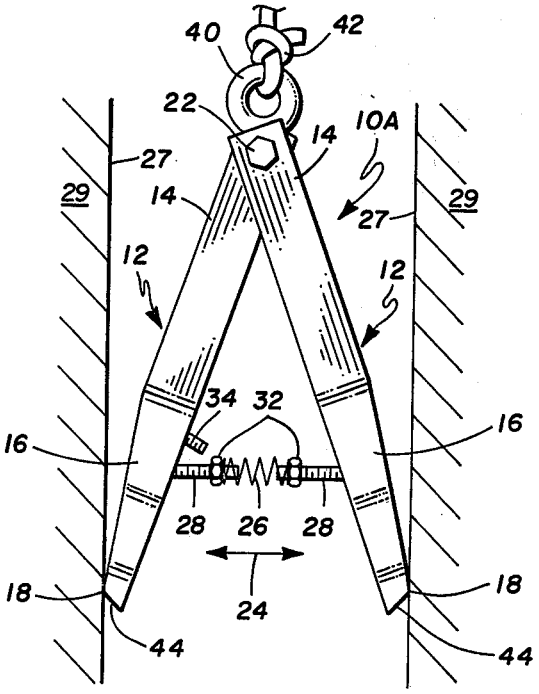
FIG. 2 is a side view of the embodiment of FIG. 1 in a chimney.
Figure 4:
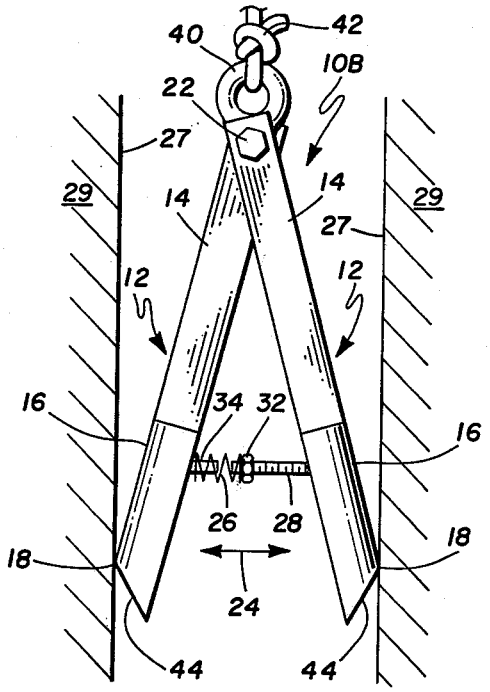
FIG. 4 is a side view of the embodiment in FIG. 3 inside a chimney.

FIGS. 1 and 2 illustrate a preferred embodiment of chimney cleaner device 10A of the present invention which is used for cleaning rectangular shaped chimneys, and FIGS. 3 and 4 illustrate another preferred embodiment of chimney cleaner device 10B which is used for cleaning circular shaped chimneys.

Both devices 10A and 10B have generally the same elements, and operate in the same manner. For that reason like reference characters indicating like elements will be used in describing both devices 10A and 10B.

Chimney cleaner devices 10A and 10B include a pair of diverging cleaning arms 12. Each cleaning arm 12 preferably has a slender shank section 14 and an integral blade portion 16. The blade portions 16 of chimney cleaner device 10A have a rectangular lateral cross-section and is used to clean rectangular shaped chimneys. The blade portions 16 of chimney cleaner device 10B have a lateral arcuate surface and are used to clean circular shaped chimneys. Each blade portion 16 has an outermost scraping edge 18 for scraping the chimney. Each pair of cleaning arms 12 are pivotally attached to each other preferably near the end of shank 14 opposite blade portion 16. Cleaning arms 12 are pivotally connected preferably by a bolt 22 freely extending through an aperture (not shown) in one arm and fixed to the other cleaning arm.

Blade portions 16 are spaced from each other and are biased in an outwardly direction, as indicated by arrows 24, by coil springs 26. Coil springs provide a lateral force for the scraping edges 18 to engage inside surfaces 27 of chimneys 29, as shown in FIGS. 2 and 4. Coil springs 26 are preferably held in place by threaded rods 28 which are threaded into holes in the inside surfaces 30 of blade portions 16. Each blade portion 16 has at least one threaded rod 28, and the rods 28 are in approximate coaxial alignment so that opposite ends of coil spring 26 can encompass the exterior ends of threaded rods 26. Nuts 32 threaded on rods 28 act as stops to limit the lateral amount each end of the coil spring encompasses the threaded rods 28. Nuts 32 are adjustable along threaded rod 28 to vary the spacing between blade portions 16.

To shorten the distance between blade portions 16, rod 28 from one blade portion 16 is removed from threaded aperture 33, as shown in FIG. 3, and short rod 34 is used instead. The remaining rod 28 of the other blade portion 16 and short rod 34 are then placed in approximate coaxial arrangement by the blade portions 16 being pivoted toward each other. Spring 26 is held between the rods by encompassing short rod 34 and a portion of rod 28 up to nut 32. In one successful embodiment of the present invention, the space between blade portions 16 is adjustable from six inches to fourteen inches, using the method described above.

Eyehook 40 is pivotally engaged to bolts 22 between end portions 20 of cleaning arms 12, by the bolt 22 freely extending through an aperture (not shown). Eyehook 40 serves as a preferable point of attaching rope 42 to the device of the present invention, as shown in FIGS. 2 and 4. Eyehook 40, being pivotally attached to cleaning arm 12, does not interfere with the cleaning arm's pivotal movement.

Cleaning arms 12 are preferably made of solid metal, such as cast iron and are of considerable weight. The total weight of the device is $11\frac{3}{4}$ pounds, and the weight of each arm 12 is preferably in a range of 5 pounds to about $5\frac{3}{4}$ pounds, with most of the weight concentrated in the blade portion 16 at the lower end of arm 12. This distribution of weight provides an inward lateral force which is opposite to the outward lateral force provided by bias spring 26. The outward lateral force is balanced against the inward lateral force such that the cleaning arms, even though biased outwardly against the chimney surfaces, move slightly inward, avoiding offsets in the chimney thereby permitting downward movement. Beveled surfaces 44 extend from scraping edges 18 slanting inwardly to the end of blade portions 16. Beveled surfaces 44 along with the weight of cleaning arms 12 further aid downward movement of the device by helping to overcome the lateral force being exerted by bias spring 26 which holds cleaning arms 12 against the inside surfaces 27 of chimneys 29.

The cleaning arms 12 of both embodiments are cast from the same mold and have shank sections 14 which are slightly offset to one side of the blade portions 16. The offset shank sections 14 permit the blade portions 16 to pivot symmetrically with respect to each other. The fabrication of the cleaning arms 12 from the same mold provides an economical method of manufacture.

Chimney 29 with inside surfaces 27 is shown being cleaned by cleaning device 10 in FIGS. 2 and 4. Rope 42, being tied to eyehook 40, is used to raise and lower the chimney cleaning devices 10A or 10B inside chimneys 29. Spring 26 biases cleaning arms 12 outwardly such that outermost scraping edges 18 engage surfaces 27 of chimneys 29 sufficiently to dislodge soot, creasol and other debris that has collected on inside surfaces 27. The weight of devices 10A and 10B and beveled surfaces 44 overcomes the lateral force exerted by spring 26 to the chimney surfaces 27, permitting downward movement of device 10 while cleaning arms 12 are still engaging surfaces 27. Devices 10A and 10B are moved upward through chimeny 29 by pulling rope 42. The triangular configuration formed by the diverging cleaning arms 12 permits upward movement without problems from offsets in the chimneys. Likewise, beveled surfaces 44 permit movement in a downward direction without encountering problems from offsets in the chimneys. Thus, scraping edge 18, by scraping in both upward and downward directions, dislodges soot, creasol and any other debris that has collected from, the inside surfaces 46 of chimney 29.

CONCLUSION

The present invention provides a simple chimney cleaner device with a minimum amount of parts that is lowered into the chimney with a rope and will clean by scraping the inside surfaces of a chimney in both an upward and downward direction. The chimney cleaner device is durable and will not be damaged by extended use, since it is made from cast iron.

Although the present invention has been described with reference to the preferred embodiments, workers skilled in the art will recognize that changes may be made in form and detail without departing from the spirit and scope of the invention.

What is claimed is:

1. A chimney cleaner device for use in cleaning inside surfaces of a chimney in both an upward and downward direction, the device comprising:

a pair of diverging cleaning arms, each cleaning arm having an integral upper shank portion and lower blade portion, the blade portion having an outermost scraping edge and a beveled surface slanting inwardly from the scraping edge to a lower end of the blade portion and the blade portion having most of the cleaning arm weight;

pivotal connecting means for pivotally connecting the cleaning arms at an upper end of the shank portion; and biasing means for providing a lateral outward force to bias the blade portions of the cleaning arms outwardly about the pivotal connecting means in a diverging manner sufficient to bring the scraping edge into engagement with the inside surfaces of the chimney as the device is raised and lowered in the chimney with the weight of the combined cleaning arms overcoming the lateral force of the biasing means sufficiently to permit gravitational downward movement of the cleaner device.

2. The device of claim 1 wherein the cleaning arms are each fabricated of cast iron as a unitary piece.

3. The device of claim 1 wherein the pivotal connecting means comprises a bolt extending through an aperture at an upper end of the shank portion of one arm and fixedly connected to an upper end of the shank portion of the other arm.

4. The device of claim 3 and further comprising an eyehook pivotally engaging the bolt between the shank portions for securing a line thereto.

5. The device of claim 1 wherein the biasing means is a coil spring held between the blade portions by approximately coaxial rods attached to the inside surfaces of the blade portions.

6. The device of claim 1 wherein the lateral cross-section of the blade portion is rectangular for use in cleaning rectangular shaped chimneys.

7. The device of claim 1 wherein the lateral outer surface of the blade portion is arcuate for use in cleaning circular shaped chimneys.

8. The device of claim 1 wherein the cleaning arms pivot symmetrically about a perpendicular plane through the pivotal connection.

9. The device of claim 1 wherein the weight of the device is approximately $11\frac{3}{4}$ pounds.

* * * * *